US010401025B2

(12) United States Patent
Breccia et al.

(10) Patent No.: US 10,401,025 B2
(45) Date of Patent: Sep. 3, 2019

(54) GAS BURNER WITH MULTI-RING MAIN FLAMES

(71) Applicant: Defendi Italy S.r.l., Camerano (IT)

(72) Inventors: Luca Breccia, Camerano (IT); Girolamo Emiliani, Camerano (IT); Marco Sbaffi, Camerano (IT)

( * ) Notice: Subject to any disclaimer, the term of this patent is extended or adjusted under 35 U.S.C. 154(b) by 71 days.

(21) Appl. No.: 15/557,090

(22) PCT Filed: Apr. 21, 2016

(86) PCT No.: PCT/IB2016/052272

§ 371 (c)(1),
(2) Date: Sep. 9, 2017

(87) PCT Pub. No.: WO2016/170497

PCT Pub. Date: Oct. 27, 2016

(65) Prior Publication Data

US 2018/0106476 A1 Apr. 19, 2018

(30) Foreign Application Priority Data

Apr. 24, 2015 (IT) ..... VE2015A0017
Apr. 24, 2015 (IT) ..... VE2015A0018
Sep. 24, 2015 (IT) ..... 102015000055002

(51) Int. Cl.
*F23D 14/06* (2006.01)
*F24C 3/08* (2006.01)

(52) U.S. Cl.
CPC ..... *F23D 14/065* (2013.01); *F24C 3/082* (2013.01); *F24C 3/085* (2013.01); *F23D 2900/14062* (2013.01)

(58) Field of Classification Search
CPC ..... F23D 14/065
USPC ..... 431/284; 126/39 E
See application file for complete search history.

(56) References Cited

U.S. PATENT DOCUMENTS 8,221,116 B2 * 7/2012 Biagioli ..... F23D 14/065 431/284
2010/0092902 A1 * 4/2010 Paesani ..... F23D 14/065 431/354
2010/0313873 A1 * 12/2010 Zhou ..... F23Q 3/002 126/39 BA

FOREIGN PATENT DOCUMENTS

EP 2503237 9/2012
WO 2006077086 7/2006
WO 2010105748 9/2010

* cited by examiner

*Primary Examiner* — Avinash A Savani
(74) *Attorney, Agent, or Firm* — Themis Law

(57) ABSTRACT

A gas burner with multiple rings of main flames includes an injector holder structure; a central distribution chamber within a central flame divider element that is rigid with the injector holder structure, generates a central ring of flames, and is closed by a circular cover; an annular distribution chamber having an annular flame divider element that is rested on the injector holder structure, generates at least one ring of main flames concentric with the central ring of flames, is separated from the central distribution chamber by an annular space, and is closed by an annular cover; and first and second venturi conduits that are substantially horizontal and parallel, are situated in the injector holder structure outline, and have inlet ends facing injectors associated with a wall of the injector holder structure and outer ends opening into cavities communicating with the central distribution chamber and with the annular distribution chamber.

15 Claims, 6 Drawing Sheets

Figure 1:
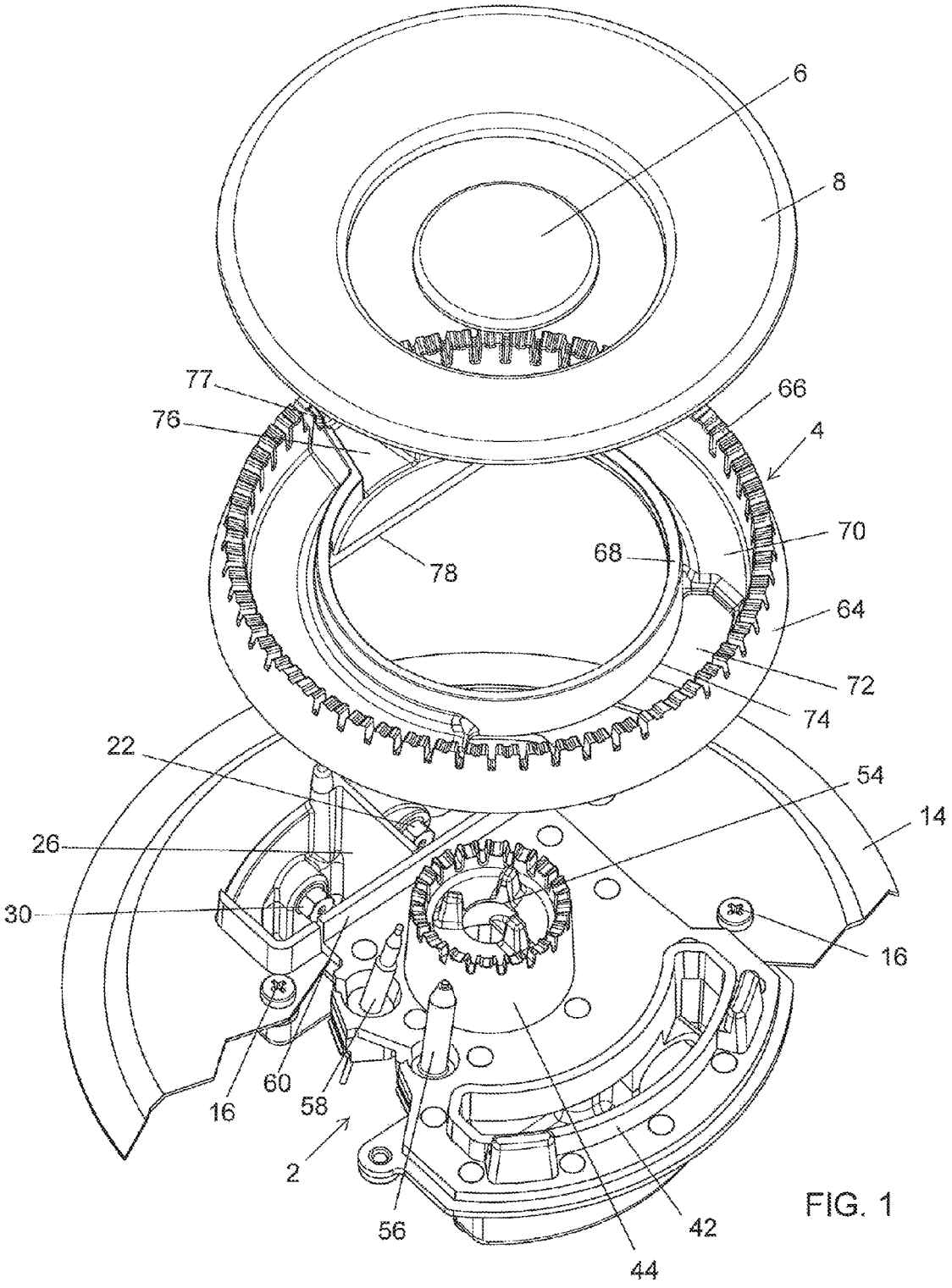

FIG. 3
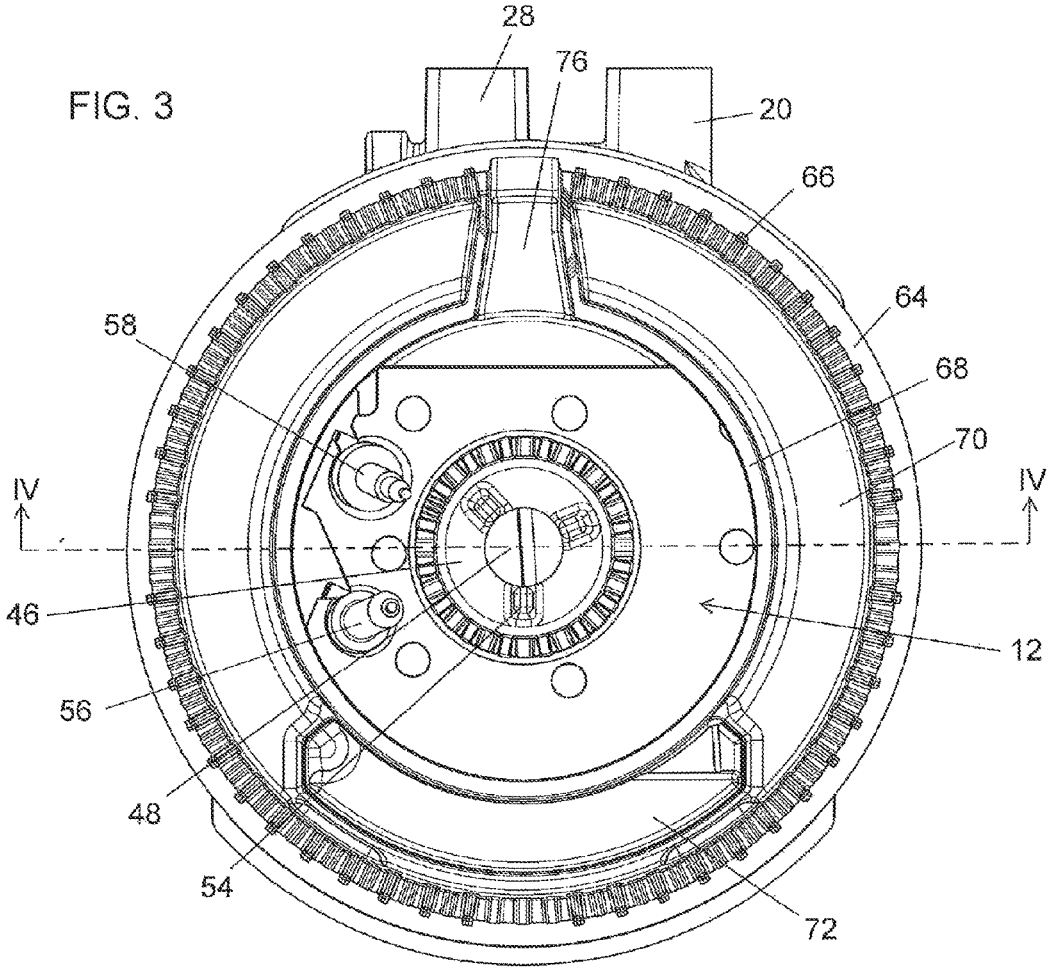
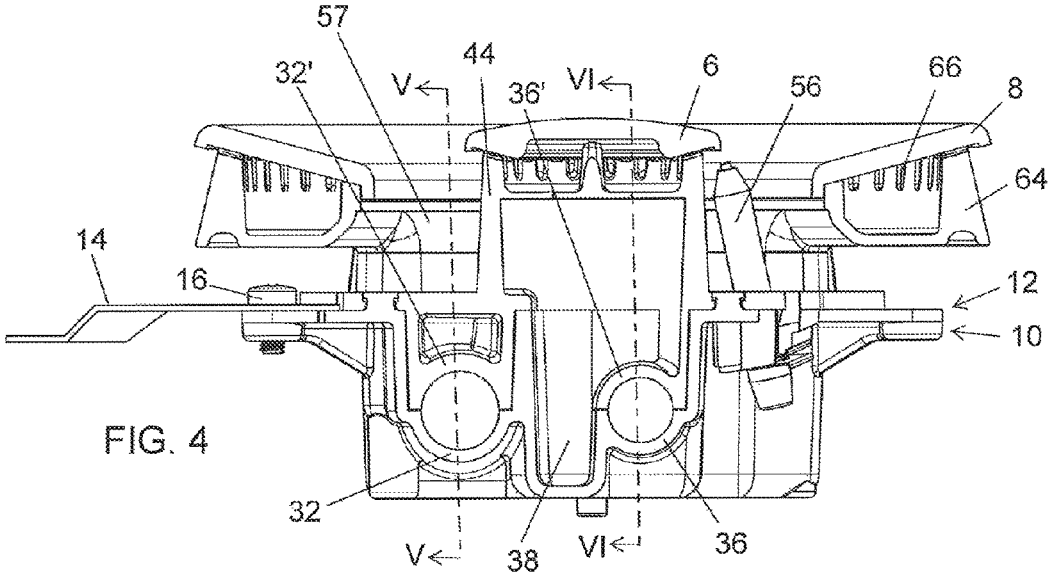
FIG. 4

GAS BURNER WITH MULTI-RING MAIN FLAMES

The present invention relates to an improved gas burner with multiple flame rings.

Gas burners with two or more rings of main flames are known for cooking hobs; these burners have an inner circular portion, which generates an internal ring of flames, and an outer annular portion, which generates one or two flame rings concentric with the inner ring.

A burner of this type can generally have one or more injectors, from which a gas flow emerges, the rate of which is controlled by a cock operable by the user by means of a knob.

In the case of a single injector or of several injectors connected to a single cock outlet, all the flame rings are adjusted simultaneously by that cock, and the burner is currently known as "multi-ring".

In contrast, in the case of several injectors connected to two different cock outlets, the burner rings can be adjusted with a certain independence, by using a particular two-way cock; in this case the burner can be adjusted from a condition of minimum delivered power, in which the outer ring or outer rings are not fed, and the inner ring is fed at minimum level, to a condition of maximum delivered power in which all the rings are fed at maximum level. This type of burner is commonly known as "dual".

From a constructional viewpoint, known multiple flame ring burners, whether multi-ring or dual, comprise an injector holder, a burner body positioned on the injector holder, a flame divider positioned on the burner body, and one or two covers positioned on the flame divider.

The injector holder of traditional multiple flame ring burners is generally cup shaped and is provided with a circumferential flange, at which the burner can be fixed to the sheet metal of a cooking hob. One or more connectors for the gas feed conduits are provided in the injector holder, together with one or more threaded seats for applying the injectors, which must evidently be mutually interchangeable, depending on the type of gas feeding the burner.

The burner body, which in certain cases is produced as a single piece with the injectors, comprises one or more venturi conduits, in which the gas is mixed with primary air entrained by the gas itself which leaves the injectors The flame divider generally consists of a hollow piece, which rests on the burner body and presents one or more chambers for distributing the mixture to one or more sets of ports, through which it can then leave to form the flame ring or rings.

The distribution chamber can also complete the mixing procedure if this has not been completed in the venturi conduits of the burner body.

The cover generally comprises a discoidal portion which upperly bounds the inner circular distribution chamber of the flame divider, and an annular portion which upperly bounds the outer annular distribution chamber of the flame divider.

Depending on the burner type, the two cover portions can either be separate or be joined together by radial connection portions.

The market offers a vast range of burners of both types, and, according to requirements, each user makes individual choices by emphasizing certain burner aspects while rejecting others.

Whatever the characteristics of the different types of known multiple flame ring burners, these present certain drawbacks which the present invention proposes to eliminate.

One of these drawbacks consists of the laborious sheet metal spot-facing operations on the surfaces of the various burner components, which have to be coupled together such as to ensure a substantial coupling seal. In particular, these spot-facing operations are even more complex if several separate spot-faced surfaces are present in each burner component, because in this case, the laboriousness of the spot-facing operations is increased by the laboriousness linked to the need to ensure perfect coplanarity between these surfaces.

A further drawback is the inevitable constructional inaccuracy of the so-called spark gap, i.e. by the distance between the electrode of the ignition spark plug, which is generally applied to the injector holder, and the burner surface, to which it discharges the spark, and which generally pertains to the flame divider or the cover. In this respect, while on the one hand, correct ignition requires a precise distance between these two, and hence a minimum spark gap tolerance, on the other hand this tolerance is the sum of several tolerances, such as the tolerance of the spark plug seat, the tolerance of the functional height of the injector holder cup, the tolerance of the functional height of the flame divider, the tolerance of the distance between spark-plug axes, the coupling slack between the injector holder cup and the flame divider, etc.

Another drawback is the poor burner flexibility in adapting to the appearance and functional requirements of the various countries, which compel burner manufacturers to produce a wide range of products to cover the most varied market requirements.

WO2010/105748 describes a gas burner for cooking hobs, in which the flame divider element which generates the central flame ring, and the flame divider element which generates the two outer annular rings, are made as a single piece, which rests on the injector holder. This does not ensure rigorously correct and precise positioning of the ignition spark-plug and of the thermocouple which are fixed to the injector holder, with respect to the central distribution chamber, which is in fact formed as a separate element from the injector holder and rests on it, with inevitable mutual positioning inaccuracies.

Moreover, the need to form a satisfactory seal within the passages for the combustion mixture which forms within the venturi conduits provided in the injector member, and which has to reach the distribution chambers provided in the flame divider positioned on the injector holder, requires a considerable area of spot-faced surfaces, which are laborious and costly to produce.

EP 2503237 describes a gas burner with a circular body, in which an internal circular distribution chamber for generating an internal flame ring and an outer annular distribution chamber for generating an outer flame ring are formed. Between the two distribution chambers a diametrical support for an ignition spark-plug and for a thermocouple are provided, which consequently do not present a rigorously precise position relative to the inner distribution chamber with which they have to interact. Moreover, the two venturi conduits extend external to the overall outline defined by the outer annular flame divider, resulting in a series of restrictions in the manner of installing the burner in the cooking hob, and involving in any event a considerable overall size of the burner.

An object of the invention is to eliminate or at least reduce these drawbacks, by a gas burner with multiple flame rings for a cooking hob, which can be used either as a "multi-ring" or as a "dual" burner.

Another object of the invention is to provide a multiple flame ring burner which can withdraw the primary air for forming the combustion mixture intended to feed either the central flame ring or the outer flame rings from either above or from below the cooking hob.

Another object of the invention is to provide a multiple flame ring burner, in which minimum spark gap tolerance can be achieved without using very high machining precision.

Another object of the invention is to provide a multiple flame ring burner, which is of high flexibility from both the appearance and functional aspect, and is therefore able to satisfy a high number of different market requirements.

Another object of the invention is to provide a multiple flame ring burner, in which the injectors can be easily replaced to adapt the burner to different gases, without having to demount the burner or having to remove it from the cooking hob.

Another object of the invention is to provide a multiple flame ring burner, in which the distance between the injector or injectors and the venturi conduit or venturi conduits can be adjusted comfortably and effectively, based on the characteristics of the feed gas.

Another object of the invention is to provide a multiple flame ring burner having a small overall plan size.

Another object of the invention is to provide a multiple flame ring burner which, compared with traditional burners, is characterised differently in constructional and performance terms.

Another object of the invention is to provide a multiple flame ring burner which is of simple, quick and low-cost production.

All these objects and others which will be apparent from the ensuing description are attained according to the invention by an improved gas burner with multiple flame rings as defined in claimed 1.

Figure 2:
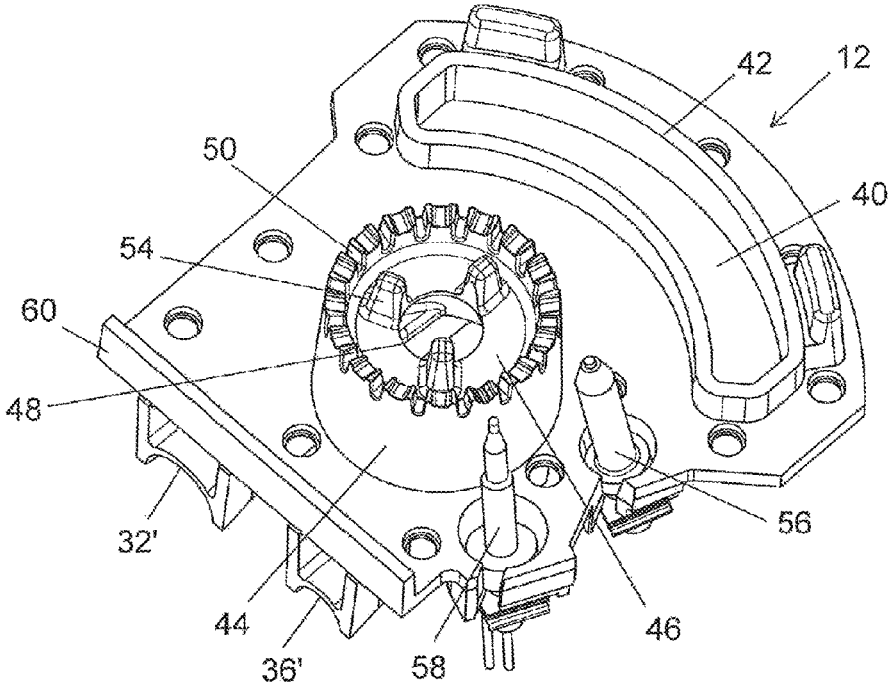
Figure 2:
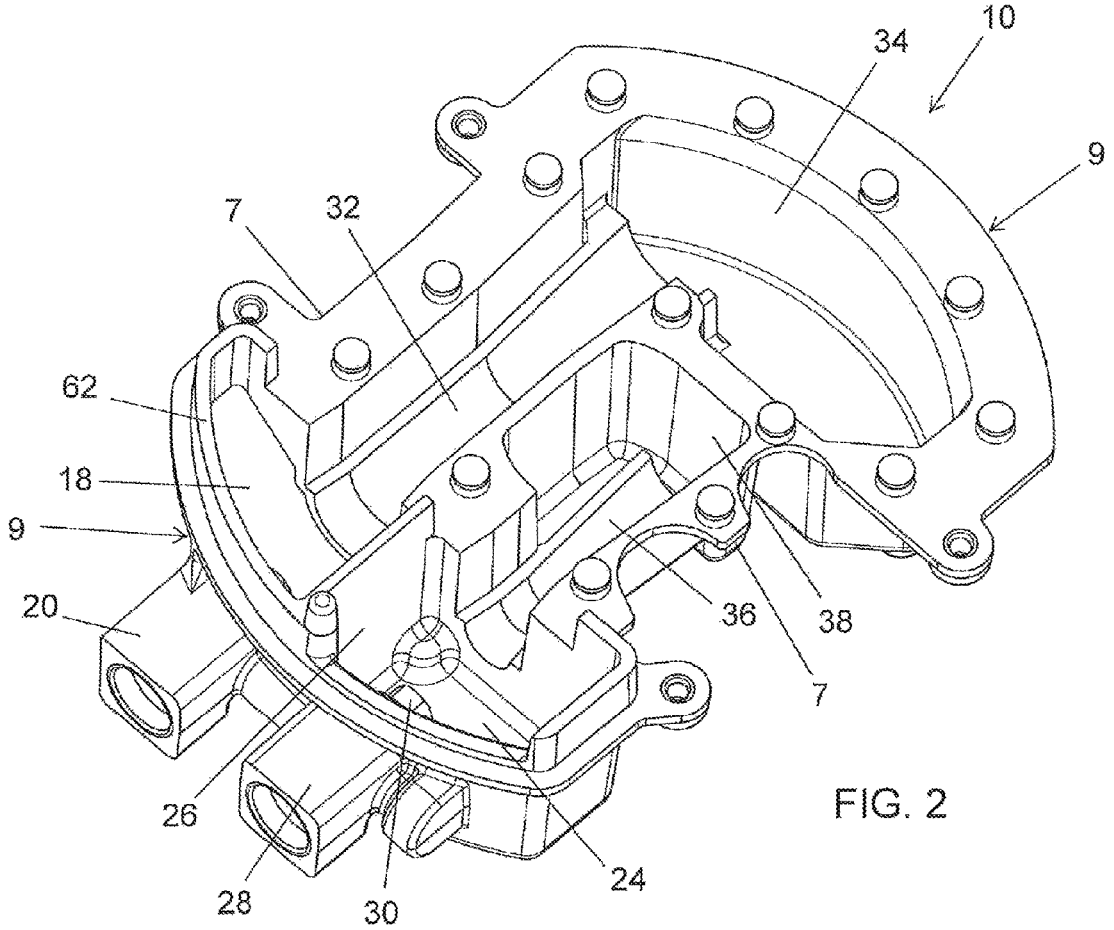
Figure 5:
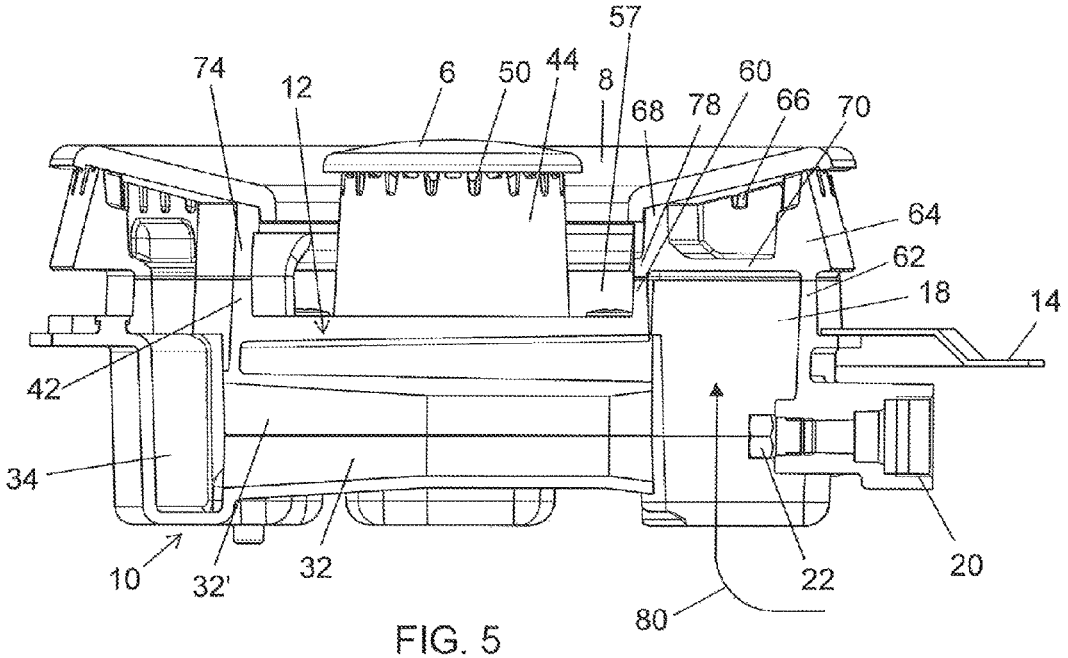
Figure 6:
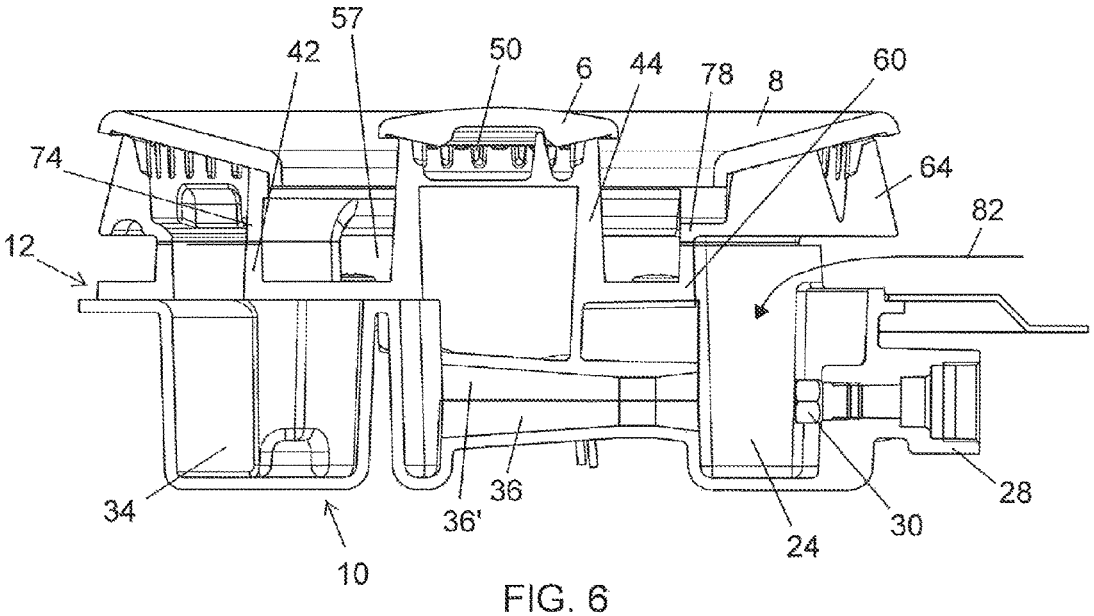
Figure 7:
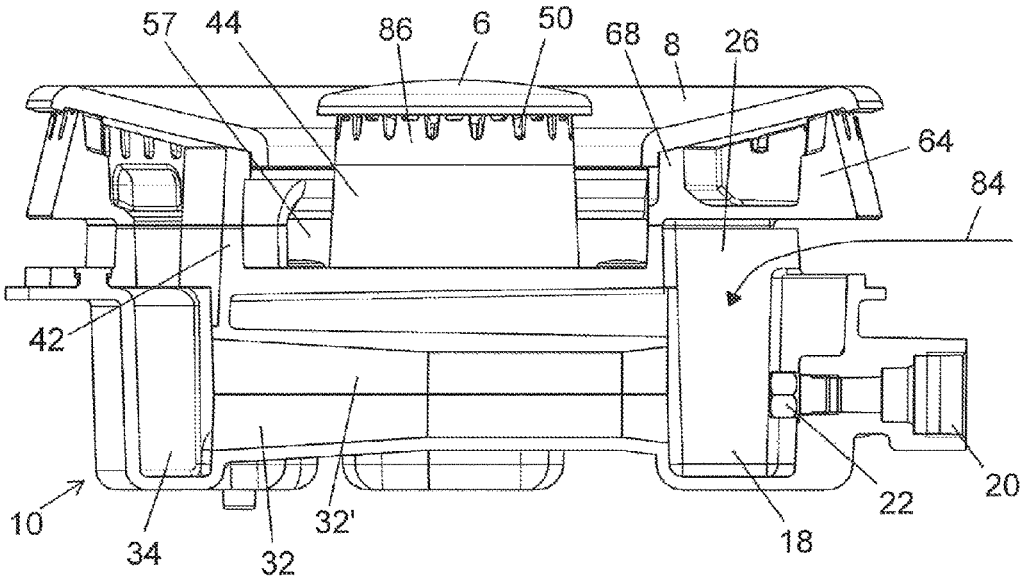
Figure 8:
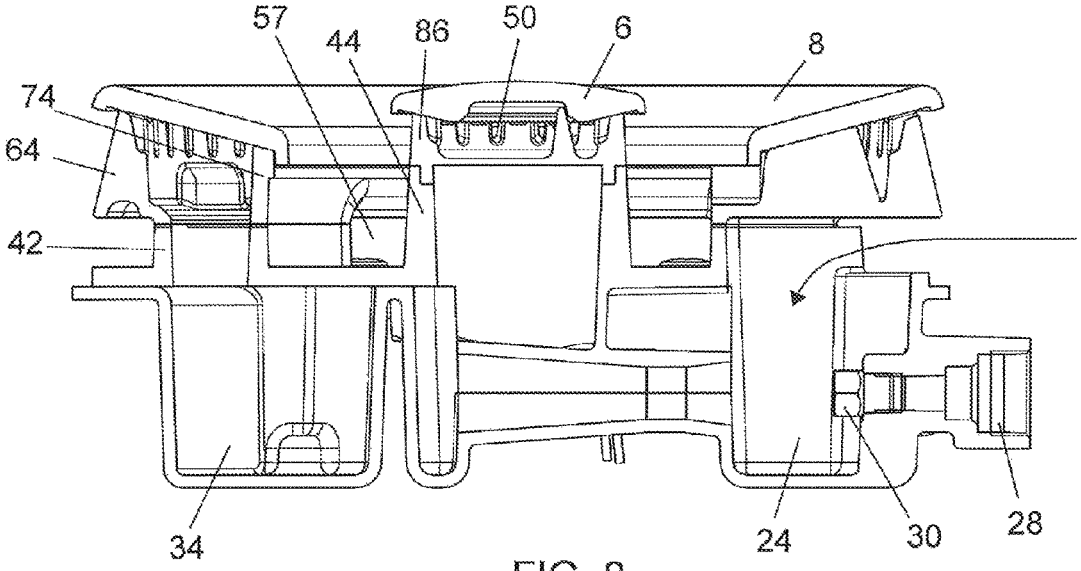
Figure 9:
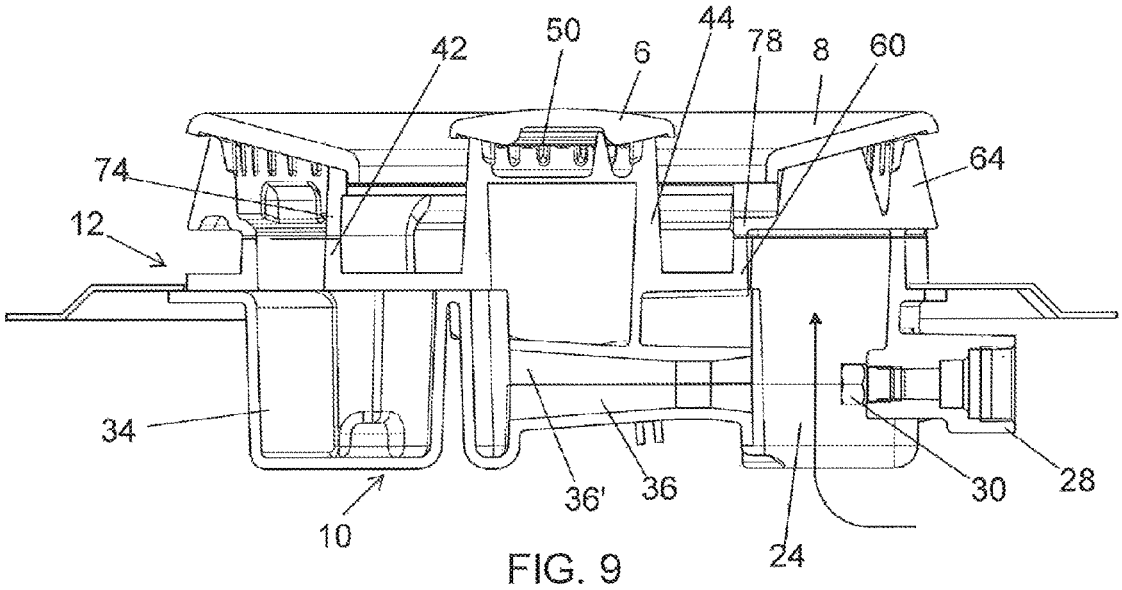
Figure 10:
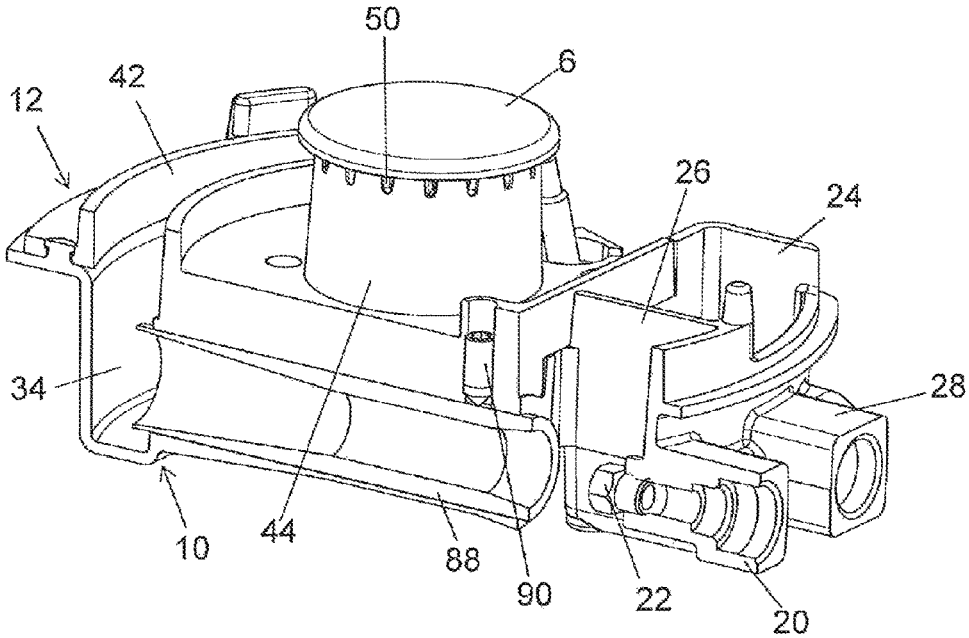

The present invention is further clarified hereinafter in terms of some preferred embodiments thereof, with reference to the accompanying drawing, in which:

FIG. 1 is an exploded perspective view of a burner according to the invention with the injector holder applied to a cooking hob, FIG. 2 is an exploded perspective view showing the two components of the injector holder, FIG. 3 shows the mounted burner in plan view, FIG. 4 is a vertical section therethrough taken on the line IV-IV of FIG. 3, FIG. 5 is a vertical section therethrough taken on the line V-V of FIG. 4, FIG. 6 is a vertical section therethrough taken on the line VI-VI of FIG. 4, FIG. 7 shows a second embodiment thereof in the same view as FIG. 5, FIG. 8 shows this second embodiment thereof in the same view as FIG. 6, FIG. 9 shows a third embodiment thereof in the same view as FIG. 6, FIG. 10 shows a perspective view of a fourth embodiment thereof, with the burner body shown partially sectioned.

As can be seen from the figures, the improved burner according to the invention is formed essentially from four components, i.e. from a burner body 2, from an annular flame divider 4 and from two covers 6 and 8.

The burner body 2 is formed in reality from two parts, i.e. an injector holder cup 10 and from a cover element 12, which can be fixed permanently together by rivets or be removable by using screws.

The burner body 2 has a plan shape which can be envisaged as deriving from an approximately circular form which at its edges 7 is deprived of two diametrically opposing circular segments which define two opposing portions of the arched edge 9.

The burner body 2 is intended to be applied from below to the sheet metal 14 of a cooking hob, and to be fixed to it for example by screws 16 which also fix together the injector holder cup 10 and the cover element 12. To aid the fixing of the burner body 2 to the hob sheet metal, this latter is provided with an aperture for passage of upwardly projecting portions of said cup 10, which rests with its remaining flat portions on the edge of the aperture itself.

In the injector holder cup 10 of the burner body 2, six upwardly open cavities are provided, namely:

a first cavity 18, which is also open lowerly and has a curved wall provided externally with a first gas connector 20 and internally with a threaded seat for a first injector 22, a second cavity 24 closed lowerly and having a lateral wall 26 separating it from the first cavity 18, and a curved lateral wall provided externally with a second gas connector 28 and internally with a threaded seat for a second injector 30, a third cavity 32, aligned with the axis of the first gas connector 20 and of the first injector 22 and forming the lower longitudinal half of a first venturi conduit, which connects the first cavity 18 to a fourth cavity 34, a lowerly closed fourth cavity 34 which, with respect to the burner longitudinal dimension defined in the direction of the third cavity 32, is situated in the opposite part to that in which the two cavities 18 and 24 are provided, a fifth cavity 36, aligned with the axis of the second gas connector 28 and of the second injector 30 and forming the lower longitudinal half of a second venturi conduit, which connects the second cavity 24 to a sixth cavity 38, a lowerly closed sixth cavity 38 positioned in the central part of the injector holder cup 10.

The cover element 12 of the burner body 2 has a plan shape substantially corresponding to that portion of the injector holder cup 10 not comprising the first cavity 18 and the second cavity 24. It is provided with an arched slotted aperture 40 which is provided with a raised perimetral edge 42 and has a shape such that when the cover element 12 is connected to the injector holder cup 10, it corresponds exactly to the fourth cavity 34.

From the lower surface of the cover element 12, two parallel longitudinal raised portions project downwards, in which two cavities 32' and 36' are provided, which form the upper half respectively of the first venturi conduit and of the second venturi conduit, i.e. two cavities complementary to the third cavity 32 and to the fifth cavity 36.

Both the first venturi conduit 32, 32' and the second venturi conduit 36, 36' are substantially horizontal and parallel, and are situated in said body 2 within the plan outline defined externally by said annular flame divider element 4.

Besides being provided with the perimetral raised portion 42 of the slotted aperture 40, the upper surface of the cover element 12 is provided centrally with a projecting appendix of slightly frusto-conical shape and forming the central flame divider element 44 of the burner. It is positioned above the sixth cavity 38 of the injector holder cup 10 and is provided in a central position with a horizontal baffle 46, provided centrally with a circular hole 48.

The upper edge of the projecting appendix 44 is provided with radial recesses 50 for feeding an internal circular flame ring. These recesses are bounded upperly by the circular cover 6, which interacts with three raised centring portions 54, facing upwards from the baffle 46.

An ignition spark-plug 56 and a thermocouple 58 are fixed to the cover element 12 in which the central flame divider 44 is formed, and in this manner assume a precise and stable position relative to said central flame divider 44.

That transverse edge of the cover element 12 distant from the aperture 40 is provided with a raised portion 60 which when the cover element is fixed to the injector holder cup 10, is positioned at the inner edge of the combination formed by the first cavity 18 and second cavity 24. This raised portion 60 represents a prolongation of a similar raised portion 62 provided in the injector holder cup 10, such that the first cavity 18 is completely bounded by a raised edge consisting of a raised portion 60, a raised portion 62 and the upper part of the baffle 26, and such that the second cavity 24 is bounded, with the exclusion of a part corresponding to the wall provided with the second gas connector 28, by a raised portion 60, by a raised portion 62 and by the upper part of the baffle 26.

The outer annular flame divider 4, which is formed as a separate part separated from the central flame divider 44, has an outer frusto-conical wall 64 provided with a plurality of radial recesses 66, and an inner wall 68 connected to the outer wall 64 by an annular flange 70, which presents an aperture 72 of shape and dimensions equal to those of the aperture 40 of the cover element 12. This aperture 72 is provided with a downwardly facing edge 74 intended to adhere to the raised edge 42 of the slotted aperture 40 when the flame divider 4 rests on the burner body 2.

Both the outer wall 64 and the inner wall 68 of the flame divider 4 present an interruption in a part diametrically opposite to the aperture 72, in which part the inner wall 68 is prolonged to join the outer wall 64 to define, with the annular flange 70, a radial channel 76 intended for cross-ignition between the inner flame ring and the outer flame ring of the burner, and provided for this purpose with cross-ignition ports 77. The base of this channel 76 extends slightly inwards and is bounded by a transverse edge 78 which faces downwards and cooperates with the raised part 60 of the cover element 12.

The annular cavity defined by the outer wall 64, by the inner wall 68 and by the flange 70 of the flame divider 4, forms the distribution chamber for the outer flame ring and is closed upperly by the annular cover 8, which upperly bounds the radial recesses 66.

The annular distribution chamber for the outer flame ring is separated from the central distribution chamber by an annular space 57.

When under operating conditions, the first and second gas connector 20, 28 are connected to a cock (not shown) for controlled gas delivery, the burner body 2 is fixed by screws 16 to the sheet metal 14 of the cooking hob, and the flame divider 4 rests on the burner body 2 at the raised portions 42 and 74 and at the raised portions 60 and 78. The cooperating surfaces of these raised portions 42, 74 and 60, 78 are spot-faced for more precise substantially sealed contact.

Again when under operating conditions, the two covers 6 and 8 are positioned respectively on the central flame divider 44 and on the annular flame divider 4.

Under these conditions, the gas which leaves the injector 22 enters the horizontal venturis 32, 32' and entrains with it air, which enters from below the cooking hob, and enters the first cavity 18 through its lower aperture, in accordance with the path indicated by the arrow 80 in FIG. 5.

The gas and primary air mix together in the venturi 32, 32' and the mixture formed in this manner reaches the fourth cavity 34, which is open only upperly, and then by way of the facing apertures 60 and 72 it becomes distributed within the annular cavity of the outer annular flame divider 4, to feed the flames of the outer ring. In the drawings, the annular flame divider 4 is represented by a single ring of flames facing outwards from the burner, but the flame divider 4 can also by provided with two flame rings, i.e. also with a ring of flames facing the central flame divider 44.

In contrast, the gas which leaves the injector 30 enters the horizontal venturi 36, 36' by way of the interruption in the raised portion 62, and entrains the primary air originating from above the cooking hob in accordance with the path indicated by the arrow 82 in FIG. 6.

The gas and primary air mix together in the venturi 36, 36', and the mixture formed in this manner reaches the sixth cavity 38, which is open only upperly, and then by way of the hole 48 in the baffle 46 it becomes distributed within the upper chamber of the flame divider 44 to feed the flames of the inner ring.

From the aforegoing it is apparent that the improved burner according to the invention is particularly advantageous compared with all traditional burners with multiple rings of main flames, and in particular:

it is of more simple construction, by virtue of the small number and reduced area of the surfaces of the burner body 2 and of the outer annular flame divider 4 needing to be spot-faced, it is of high operational reliability, by virtue of the precise positioning of the spark-plug 56 relative to the inner portion 44 of the burner and the consequent reduction in the spark gap tolerances, it is highly insensitive to the streaming effect, because the intake of primary air for feeding the inner flame ring is from above the cooking hob, injector replacement is easy without having to remove the burner, given their direct accessibility from above, it enables the burner to be used as a multi-ring or dual burner by simply connecting the two gas connectors 20 and 28 to a single or to two different outlets of the adjustment cock, it is formed from a small number of pieces, the outer annular flame divider can be easily replaced by others of different characteristics either to modify the burner appearance or to adapt the burner to the requirements of the various countries in terms of the material used, by virtue of the non-perfectly circular shape of the burner body 2, and in particular because of the elimination of its two parallel circular segments, it is slightly narrower than traditional burners of equal diameter, enabling it to be installed in cooking hobs in a slightly more peripheral position, hence increasing burner positioning options.

The second embodiment, illustrated in FIGS. 7 and 8, preserves all the already described characteristics, with the exception of the fact that the first cavity 18 is closed lowerly and its raised edge 62 presents an interruption to enable primary air to enter from above the cooking hob, in accordance with the path indicated by the arrow 84 in FIG. 7.

This second embodiment enables high insensitivity to the streaming effect to be obtained not only for the inner flame ring, but also for the outer flame ring.

Moreover, in this second embodiment, the central flame divider 44 is not made as a single piece, but has an upper ring 86 separate from the lower part 44 and provided with recesses 50. In any event, as represented in FIG. 8, the upper ring 86 is connected as a form fit, and is consequently rigid, with the underlying part 44 provided in the upper surface of the cover element 12, which forms the burner body 2. Again in this case, the central flame divider, which is formed from the underlying part 44 and from the upper ring 86, is formed as a separate part, and separate from the outer annular flame divider 4.

This embodiment is on the one hand less advantageous in that it involves a less precise spark gap execution, but on the other hand it enables the upper ring 86 of the inner flame divider, which is in contact with the flames, to be made of a different material from the material forming the underlying part 44, which is advantageous both because it makes the burner suitable for use in countries in which material regulations prescribe precise characteristics for materials in contact with flames, and because it also enables the inner central flame divider to be made different in appearance from the outer annular flame divider 4.

As seen, in this second embodiment this primary air for the outer flame ring is drawn from above the cooking hob, although in a different embodiment, not illustrated, it can be drawn from below the cooking hob, in a like manner to the embodiment illustrated in FIG. 5.

The third embodiment, illustrated in FIG. 9, presents all the aforedescribed characteristics, with the exception of the fact that the second cavity 24 is opened lowerly to enable primary air forming the combustion mixture for the inner flame ring to be drawn from below the cooking hob.

FIG. 10 illustrates a fourth embodiment of the burner, which integrates any of the aforedescribed embodiments with a further characteristic consisting of the adjustability of the distance between the inlet end of at least one of the two venturi conduits 32, 32' and 36, 36', and the respective injector 22 and 30 and, more specifically, in the particular case illustrated by the venturi 32, 32', making the venturi conduit actually movable relative to the burner body 2.

This embodiment is particularly useful if the burner is used in countries in which the feed gas composition varies between different regions of the same country. In this case it is particularly useful to be able to adapt the burner to the specific gas composition, without having to remove the burner or the cooking hob to which it is applied.

As can be seen in FIG. 9, the injector holder support 10 and the cover element 12, which in the preceding embodiments define the venturi conduit 36, 36' when coupled together, they define in this third embodiment an essentially cylindrical cavity housing an externally cylindrical conduit 88 shaped internally as a venturi. This conduit 88 is axially movable within its own cylindrical seat and can be locked in the axial desired position by a grub screw 90 which passes through a threaded hole provided in the cover element 12 and is easily accessible from above even when the burner is mounted on the cooking hob.

In this manner, when the grub screw 90 has been slackened, the venturi conduit 88 can be easily moved axially until the distance between its inlet end and the injector 22 has been brought to the value suitable for the particular feed gas composition.

To further simplify the handling of the venturi conduit 88, both its ends preferably project from its cylindrical seat, in that in this manner these ends are easily accessible from above via the upper aperture of the first cavity 18 and via the upper aperture of the fourth cavity 34.

This is also evidently valid for the venturi conduit 36, 36' which feeds the burner central cavity 38.

The invention claimed is:

1. A gas burner with multiple rings of main flames, comprising:

an injector holder structure (2) configured to be installed on an upper sheet metal of a cooking hob;

a central distribution chamber provided within a central flame divider element (44, 86), which is rigid with said injector holder structure (2), and is configured to generate a central ring of flames, said central distribution chamber being closed upperly by a circular cover (6);

an annular distribution chamber provided within an annular flame divider element (4), which is rested on said injector holder structure (2), and is configured to generate at least one ring of main flames which is concentric with said central ring of flames, said annular distribution chamber (4) being separated from said central distribution chamber by an annular space (57), and being closed upperly by an annular cover (8); and a first venturi conduit (32, 32') and a second venturi conduit (36, 36') which are substantially horizontal and parallel, and situated in said injector holder structure (2) within, and not extending external to, a plan outline defined by said annular flame divider element (4), and have an inlet end facing a respective injector (22, 30) associated with a lateral wall of respective adjacent cavities (18, 24) provided in said injector holder structure (2) and an outer end opening into respective cavities (34, 38) in fluidic connection respectively with said central distribution chamber and with said annular distribution chamber (4), wherein said injector holder structure (2) comprises a lower injector holder cup (10) and an upper cover element (12), which are coupled together.

2. The gas burner as claimed in claim 1, wherein said injector holder structure (2) has a plan shape which is substantially circular but deprived of two opposing portions (7) of circular segment shape.

3. A gas burner with multiple rings of main flames, comprising:

an injector holder structure (2) configured to be installed on an upper sheet metal of a cooking hob;

a central distribution chamber provided within a central flame divider element (44, 86), which is rigid with said injector holder structure (2), and is configured to generate a central ring of flames, said central distribution chamber being closed upperly by a circular cover (6);

an annular distribution chamber provided within an annular flame divider element (4), which is rested on said injector holder structure (2), and is configured to generate at least one ring of main flames which is concentric with said central ring of flames, said annular distribution chamber (4) being separated from said central distribution chamber by an annular space (57), and being closed upperly by an annular cover (8); and a first venturi conduit (32, 32') and a second venturi conduit (36, 36') which are substantially horizontal and parallel, and situated in said injector holder structure (2) within, and not extending external to, a plan outline defined by said annular flame divider element (4), and have an inlet end facing a respective injector (22, 30) associated with a lateral wall of respective adjacent cavities (18, 24) provided in said injector holder structure (2) and an outer end opening into respective cavities (34, 38) in fluidic connection respectively with said central distribution chamber and with said annular distribution chamber (4), wherein said central flame divider element (44) is formed as a single element with said injector holder structure (2).

4. A gas burner with multiple rings of main flames, comprising:

an injector holder structure (2) configured to be installed on an upper sheet metal of a cooking hob;

a central distribution chamber provided within a central flame divider element (44, 86), which is rigid with said injector holder structure (2), and is configured to generate a central ring of flames, said central distribution chamber being closed upperly by a circular cover (6);

an annular distribution chamber provided within an annular flame divider element (4), which is rested on said injector holder structure (2), and is configured to generate at least one ring of main flames which is concentric with said central ring of flames, said annular distribution chamber (4) being separated from said central distribution chamber by an annular space (57), and being closed upperly by an annular cover (8); and a first venturi conduit (32, 32') and a second venturi conduit (36, 36') which are substantially horizontal and parallel, and situated in said injector holder structure (2) within, and not extending external to, a plan outline defined by said annular flame divider element (4), and have an inlet end facing a respective injector (22, 30) associated with a lateral wall of respective adjacent cavities (18, 24) provided in said injector holder structure (2) and an outer end opening into respective cavities (34, 38) in fluidic connection respectively with said central distribution chamber and with said annular distribution chamber (4), wherein said central flame divider element comprises an upper element (86) which is provided with recesses (50) for feeding a combustion mixture to generate said central ring of flames and is connected as a form-fit to said central flame divider element (44) rigid with said injector holder structure (2).

5. The gas burner as claimed in claim 1, further comprising, in said lower injector holder cup (10):

a first cavity (18), in which a first injector (22) is housed;

a second cavity (24), in which a second injector (30) is housed;

a third cavity (32) forming a lower longitudinal part of said first venturi conduit (32, 32');

a fourth cavity (34) into which said first venturi conduit (32, 32') opens;

a fifth cavity (36), forming a lower longitudinal part of said second venturi conduit (36, 36'); and a sixth cavity (38) into which said second venturi conduit (36, 36') opens.

6. The gas burner as claimed in claim 1, wherein two cavities (32', 36'), forming an upper longitudinal part of said first venturi conduit (32, 32') and of said second venturi conduit (36, 36'), are formed in said upper cover element (12) of said injector holder structure (2) when said upper cover element (12) is coupled to said lower injector holder cup (10).

7. The gas burner as claimed in claim 5, wherein said second cavity (24) is closed lowerly and is provided upperly with an aperture for communication with an upper part, external to the gas burner, of the cooking hob in which the gas burner is intended to be installed, for passage of primary air entrained by gas which leaves said second injector (30).

8. The gas burner as claimed in claim 5, wherein said second cavity (24) is open upperly for intake of primary air intended to form a combustion mixture which feeds said central flame divider element (44) from below the cooking hob in which the gas burner is intended to be installed.

9. The gas burner as claimed in claim 5, wherein said first cavity (18) is closed lowerly and is provided upperly with an aperture for communication with an upper part, external to the gas burner, of the cooking hob in which the gas burner is intended to be installed, for passage of primary air entrained by gas which leaves said first injector (22).

10. The gas burner as claimed in claim 5, wherein said first cavity (18) is open lowerly for passage of primary air originating from below the cooking hob in which the gas burner is intended to be installed, and entrained by gas which leaves said first injector (22).

11. The gas burner as claimed in claim 1, wherein part of one of both of said central flame divider element (44) or of said annular flame divider element (4), in which apertures (50, 66) are provided for flame exit, is made of a material which is different from a material which forms a remaining part of the gas burner, and presents a high flame resistance.

12. The gas burner as claimed in claim 1, wherein one or both of said first or said second venturi conduits are provided within an internally cylindrical sleeve (88) housed axially move within respective cylindrical seats defined in said injector holder structure (2), and lockable in a desired axial position by at least one locking member (90) operable from above said injector holder structure (2) applied to said cooking hob.

13. The gas burner as claimed in claim 12, wherein said locking member (90) consists of a grub screw engaged in a threaded seat provided in said injector holder structure (2), a tip of said grub screw engaging an outer surface of said sleeve (88).

14. The gas burner as claimed in claim 12, wherein said sleeve (88) has a length greater than a minimum distance between a cavity (18, 24), into which an upstream end of said sleeve (88) opens, and a cavity (34, 38) into which a downstream end thereof opens.

15. The gas burner as claimed in claim 1, further comprising at least one ignition spark plug (56) and a thermocouple (58) which are applied to said injector holder structure (2) and interact with said central flame divider element (44).

* * * * *